US010954898B2

(12) United States Patent
Hruza et al.

(10) Patent No.: US 10,954,898 B2
(45) Date of Patent: Mar. 23, 2021

(54) SYSTEM FOR CONNECTING HOUSING ELEMENTS OF A DEVICE FOR HEAT TRANSFER

(71) Applicant: Hanon Systems, Daejeon (KR)

(72) Inventors: Hynek Hruza, Novy Jicin (CZ); Jan Gregus-Kollar, Skalica (SK); Karel Krajca, Hustenovice (CZ)

(73) Assignee: Hanon Systems, Daejeon (KR)

( * ) Notice: Subject to any disclaimer, the term of this patent is extended or adjusted under 35 U.S.C. 154(b) by 0 days.

(21) Appl. No.: 16/376,680

(22) Filed: Apr. 5, 2019

(65) Prior Publication Data

US 2019/0323456 A1 Oct. 24, 2019

(30) Foreign Application Priority Data

Apr. 18, 2018 (DE) ..... 10 2018 109 233

(51) Int. Cl.

| | |
|---|---|
| ***F02M 26/00*** | (2016.01) |
| ***F02M 26/29*** | (2016.01) |
| ***F02B 29/04*** | (2006.01) |
| ***F02M 26/12*** | (2016.01) |

(52) U.S. Cl.
CPC ..... *F02M 26/29* (2016.02); *F02B 29/045* (2013.01); *F02M 26/12* (2016.02)

(58) Field of Classification Search
CPC ..... F02M 26/29; F28F 2275/085; F28F 9/26; F02B 29/045
See application file for complete search history.

(56) References Cited

U.S. PATENT DOCUMENTS 4,331,201 A * 5/1982 Hesse ..... B23P 11/00 165/149
4,649,628 A * 3/1987 Allemandou ..... F28F 9/0226 165/148
4,651,815 A * 3/1987 Logic ..... F28F 9/0226 165/148

(Continued)

FOREIGN PATENT DOCUMENTS

DE 102008001660 A1 1/2009
DE 102011008220 A1 1/2012

(Continued)

*Primary Examiner* — Phutthiwat Wongwian
*Assistant Examiner* — Sherman D Manley
(74) *Attorney, Agent, or Firm* — Norton Rose Fulbright US LLP; James R. Crawford

(57) ABSTRACT

A system for connecting housing elements of a device for heat transfer having a housing with a first housing element and a second housing element which are connectable with one another with face sides oriented toward one another and via a connection under form closure. Housing elements are herein in contact on another with side margins developed in proximity of front faces. The first latching elements are implemented as recesses each with a flat surface oriented in parallel to front face. On an outer side of side margin of first housing element between each first latching element and front face, a shaping is developed protruding from side margin, which comprises on a side facing first latching element a flat surface disposed in the plane spanned by flat surface of first latching element. Flat surfaces of first latching element and the shaping form a contiguous bearing area for second latching element.

20 Claims, 5 Drawing Sheets

(56) References Cited

U.S. PATENT DOCUMENTS

| | | | | |
|---|---|---|---|---|
| 6,082,446 | A * | 7/2000 | Ahaus | F28F 9/0226 165/149 |
| 7,121,329 | B2 * | 10/2006 | Shields | F28F 9/001 165/149 |
| 9,920,686 | B2 * | 3/2018 | Somhorst | F02B 29/0462 |
| 10,215,508 | B2 * | 2/2019 | Somhorst | F28F 9/02 |
| 10,215,509 | B2 * | 2/2019 | Somhorst | F28D 1/00 |
| 2010/0282449 | A1 | 11/2010 | Merklein et al. | |
| 2011/0017742 | A1 * | 1/2011 | Sausen | B60H 1/00528 220/324 |
| 2014/0318120 | A1 * | 10/2014 | Svihla | F28F 9/0263 60/599 |
| 2016/0334174 | A1 * | 11/2016 | Somhorst | F28F 9/0226 |
| 2016/0370131 | A1 * | 12/2016 | Hermida Dom Nguez | F28D 7/16 |
| 2017/0191764 | A1 * | 7/2017 | Hruza | F28F 9/0226 |

FOREIGN PATENT DOCUMENTS

| | | | |
|---|---|---|---|
| DE | 102014207511 | A1 | 10/2014 |
| EP | 0285504 | A1 | 10/1988 |
| EP | 0372187 | A1 | 6/1990 |
| EP | 3001132 | A1 | 3/2016 |
| FR | 2875592 | A1 | 3/2006 |
| JP | S61141592 | U | 9/1986 |
| JP | S61141593 | U | 9/1986 |
| JP | 2017015351 | A | 1/2017 |
| KR | 19990028645 | A | 4/1999 |
| KR | 101175107 | B1 | 8/2012 |
| KR | 101817580 | B1 | 1/2018 |

* cited by examiner

SYSTEM FOR CONNECTING HOUSING ELEMENTS OF A DEVICE FOR HEAT TRANSFER

This application claims priority from German Patent Application No. 102018109233.4 filed on Apr. 18, 2018, which is hereby incorporated herein by reference in its entirety.

FIELD OF THE INVENTION

The invention relates to a system for connecting housing elements of a device for heat transfer, in particular for application in a motor vehicle. The device comprises a housing with a first housing element and a second housing element which are connectable with one another with their front faces oriented toward one another and across a connection under form closure.

BACKGROUND OF THE INVENTION

Heat transfer devices of the above described class serve primarily for cooling exhaust gas, particularly of internal combustion engines, which is mixed with the fresh air to be supplied to the combustion process in order to reach, on the one hand, a reduction of the oxygen content. On the other hand, the heat energy of the exhaust gas is also utilized. The heat transfer device is utilized, for example, at the suction side of internal combustion engines or in connection with fuel cells.

For this reason, a so-called charge air cooler or intercooler disposed at the suction side of an internal combustion engine is a heat transfer device serving for the decrease of the temperature of the combustion air supplied to the engine. The heat transfer device is herein developed between a compressor element, such as a turbocharger, and an inlet valve of the internal combustion engine and serves for discharging at least a portion of the heat generated through the compression of the air.

EP 0 285 504 A1 describes a heat exchanger with a two-part housing with a receiving element (tank) and a cover element. The receiving element comprises connection fittings for the air-conducting connections. The housing is implemented such that it encloses a bank of heat exchanger tubes and a passage for the air to be cooled between the connection fittings of the air. In the closed state of the housing the two housing elements are braced together using, for example, tension straps or staples. The tension straps are herein bolted together.

Prior art also discloses welding, soldering or adhering the housing elements together depending on the material of the housing elements.

DE 10 2008 001 660 A1 discloses a heat exchanger for the exhaust tract of a motor vehicle with a separately implemented exhaust gas carrying heat transfer tube which is disposed in a closed housing.

The housing through which flows a coolant is formed of a housing cover and a case part which are connected with one another with the aid of mechanical securing means, such as bolts or rivets or with the aid of connections that are free of auxiliary means, such as flanging.

The intercoolers or exhaust gas coolers known in prior art are of a highly complex structure and comprise a multiplicity of components, for example for closing the housing, such that particularly the housing can often only be fabricated involving elaborate and costly expenditures and be assembled requiring extensive lengths of time.

Housing elements of heat exchangers that are connected with one another across auxiliary means-free connections, such as latching connections, for closing the housing provide only a limited installation space for a suitable depth of the latching elements. Too shallow a depth as the dimension of a bearing area of the latching elements leads to an inadequate, in particular form-closure, connection and therewith to an increased risk of the undesirable releasing of the latching connection, especially during operation of the heat exchanger under high pressure application and high pressure pulse loading.

A greater depth as the dimension of the bearing area of the latching elements could be achieved by widening the bearing area in the direction toward the interior of the housing. However, the installation space in the direction of the volume enclosed by the housing and thus the utilizable interior installation space is extremely limited. The widening of the latching connection, especially of the bearing areas, in the stated direction would, in addition, lead to a highly extensive form change of at least one of the housing elements, which, in turn, would increase the risk of fatigue and consequently would lead to a destruction of the latching connection and therewith of the housing.

OBJECTS OF THE INVENTION

The objective of the invention comprises providing an improved system for an auxiliary means-free connection of housing elements, particularly of a device for heat transfer. The system is to be developed with minimal installation space requirements such that the undesirable release of the connection, especially during operation under high stress of the connection, for example under high pressure application and high pressure pulse loading of the heat exchanger, is prevented. The inner volume encompassed by the housing is to remain unchanged. Moreover, the system is to be simple of operation, have maximal resistance against fatigue and destruction of the connection as well as engender minimal fabrication costs and material costs.

The objective is attained through the subject matter with the characteristics of the independent patent claims. Further developments are specified in the dependent patent claims.

SUMMARY OF THE INVENTION

The task is resolved through a system according to the invention for connecting housing elements of a device for heat transfer, in particular for application in a motor vehicle. The system comprises a housing with a first housing element and a second housing element which are connectable with one another with their front faces oriented toward one another and across a connection under form closure.

Side margins of the housing elements developed in the proximity of the front faces are in contact on one another. The connection is realized as an engagement mechanism with first latching elements disposed on a side margin of the first housing element and second latching elements disposed on a side margin of the second housing element. The first latching elements are implemented as recesses, each with a flat surface oriented parallel to the front face.

The engagement mechanism comprises functional components with the first and second latching elements corresponding to one another, in particular for the releasable connection and simple joining of the housing elements under form closure. During the process of joining, one of the latching elements is elastically deformed which, at the end of the process, interlocks with the other yielding a form closure.

The first housing element and the second housing element are advantageously realized such that they in common enclose a volume.

According to the concept of the invention, on an outer side of the side margin of the first housing element a shaping or formation 9 is implemented, protruding from the side margin, between each first latching element and the front face. The shaping comprises a flat surface disposed on a side facing the first latching element in a plane spanned by the flat surface of the first latching element such that the flat surfaces of the first latching element and of the shaping form a contiguous bearing area for a second latching element.

A side margin of a housing element is preferably in each instance oriented in a perpendicular direction to the front face and in its entirety is disposed about the front face. The housing elements are to the full extent in contact with one another at their side margins.

According to a preferred embodiment of the invention one shaping extends in each case over the entire extent, oriented in parallel with the front face, of a first latching element.

The shaping protruding from the side margin is advantageously implemented on the sides, differing from the side facing the first latching element, continuously transitioning into a plane spanned by the side margin.

According to a further development of the invention, the first latching elements, disposed on the first housing element, are implemented extending from the side margin into the volume enclosed by the housing.

Between each adjacently disposed first latching elements advantageously a web is provided. The side margin of the first housing element, with the first latching elements and the webs, is herein preferably implemented as a closed, contiguous surface.

A particular advantage of the invention comprises therein that the shapings disposed on the first latching element, each with a concavely formed area starting from the side edge, are developed for receiving the second latching element of the engagement mechanism.

The first latching elements herein preferably comprise at an angular point or cusp of the concavely formed area a maximal depth as the greatest dimension with reference to the outside of the side margin.

According to a further preferred embodiment of the invention the second latching elements of the second housing element are developed as detent lugs with such form as to be receivable integrated within the first latching elements of the first housing element.

According to a further development of the invention, the second latching elements comprise each a flat surface oriented in the direction of the bearing areas of the first latching elements, wherein the bearing areas of the first latching elements of the first housing element and the flat surfaces of the second latching elements of the second housing element are disposed in contact with one another.

According to a further preferred embodiment of the invention, the second housing element comprises apertures for receiving the shapings of the first housing element.

A further advantage of the invention comprises that the housing elements have each a rectangular cross section with two long sides and two narrow sides, and the latching elements are at least developed on the long sides of the housing elements. The latching elements can also be disposed over the entire periphery and thus on the long sides as well as also on the narrow sides.

The housing elements are preferably implemented of an aluminum or a synthetic material.

In summary, the system according to the invention for connecting housing elements of a device for heat transfer, in particular of a coolant-cooled or air-cooled intercooler, comprises various advantages:

- minimal or no form chances of the second housing elements as a counter piece to the first housing element of the engagement mechanism, no change of the first housing element and consequently maintaining robustness,
- minimal installation space requirement and maximal compactness,
- minimal costs of production and minimal material expenditures,
- very simple assembly.

Further details, characteristics and advantages of the embodiments of the invention will become evident based on the following description of embodiment examples with reference to the associated drawing.

DETAILED DESCRIPTION

Figure 1A:
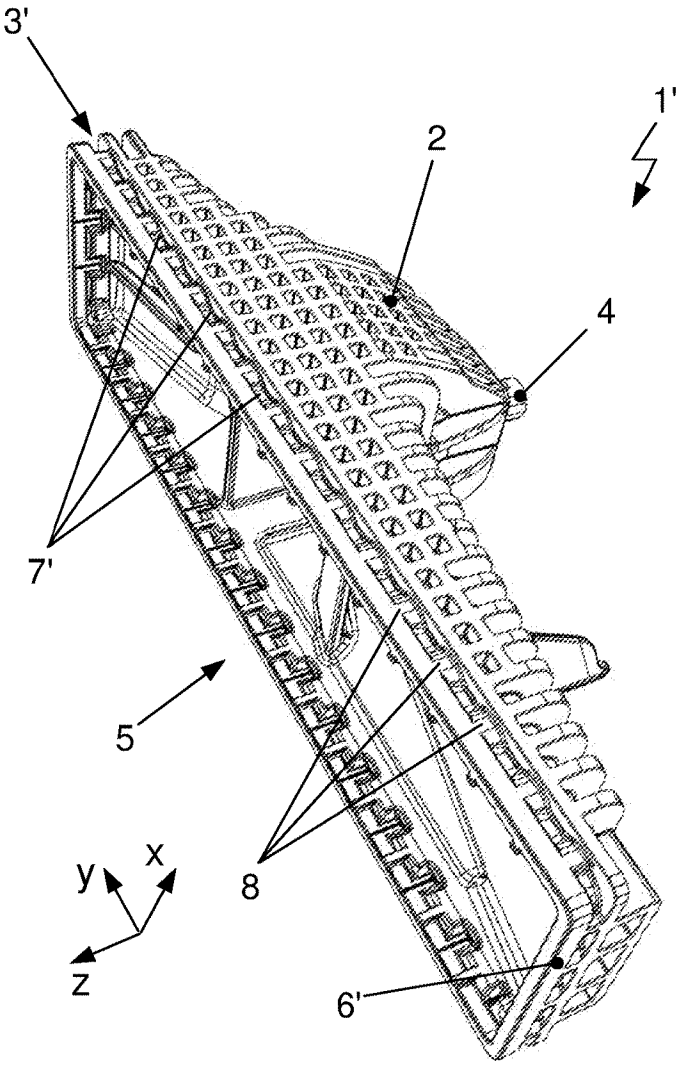
PRIOR ART Fig. 1A
FIGS. 1A and 1B: a first housing element of a device of prior art for heat transfer with a wall and a connection region in perspective view.
Figure 1B:
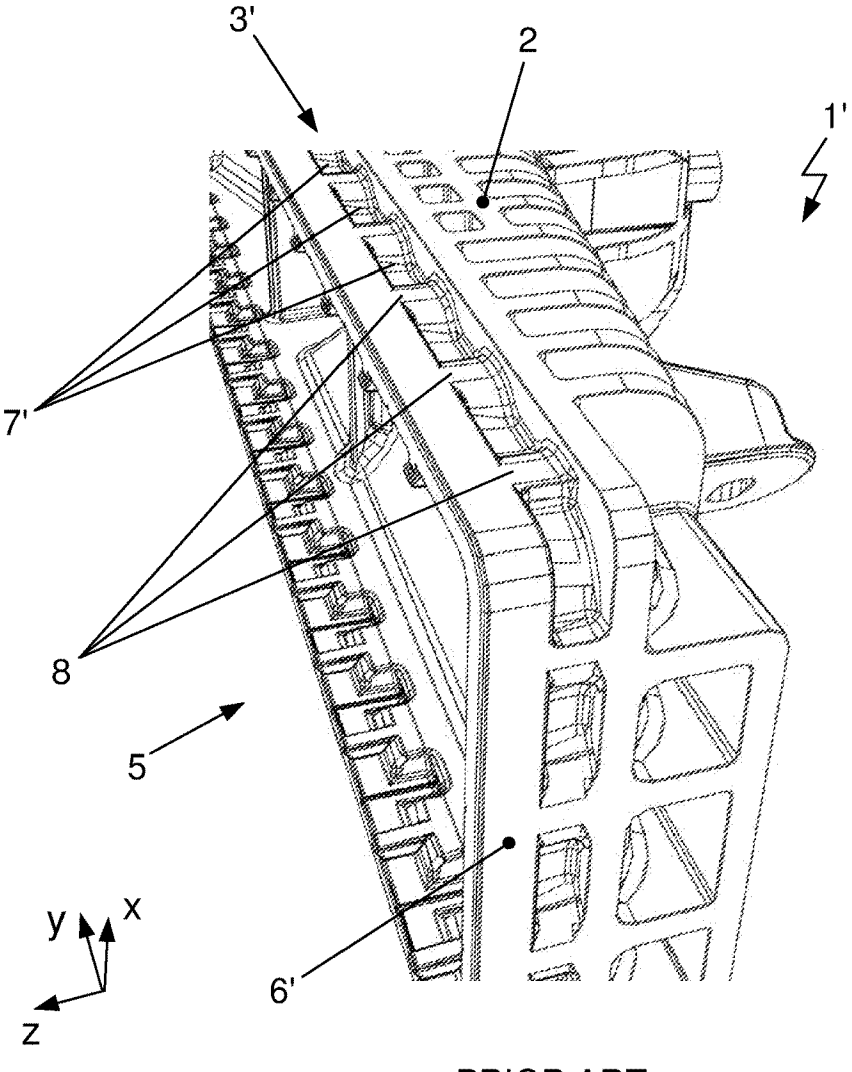
PRIOR ART Fig. 1B

In FIGS. 1A and 1B is shown a first housing element 1' of a device of prior art for heat transfer with a wall 2 and a connection region 3' in perspective view. FIG. 1B depicts a section of the first housing element 1' at an enlarged scale.

The first housing element 1' is developed to enclose, together with a second, not shown, housing element, a volume. Within the volume a heat transfer arrangement, not shown, can be integrated through which flows a first fluid and around which flows a second fluid. Heat can hereby be exchanged between the fluids. One of the fluids flows herein through a passage inlet 4 developed in the wall 2 into the volume enclosed by the first housing element 1' and by the second housing element, is routed specifically by the particular wall 2 of the housing element 1' around the heat transfer arrangement and subsequently flows through a passage, not shown, out of the volume again.

The first housing element 1' comprises a connection region 3' in which the first housing element 1' and the second housing element are disposed in contact on one another such that they close off the arrangement. The connection region 3' of the first housing element 1' and a connection region of the second housing element are each implemented as components, corresponding to one another, of an engagement mechanism for the connection under form closure of the first housing element 1' and the second housing element.

The connection region 3' is implemented in the proximity of a front face 5 of housing element 1'. The front faces 5 of housing elements 1' are oriented in a plane spanned by the directions x, y and with respect to each other such that side margins 6' of walls 2 of housing elements 1' are in their entirety in contact with one another. The side margins 6' of the housing elements 1' extending in the direction y starting from the front face 5 and implemented over the entire periphery about the front faces 5 overlap. In the region of overlaps of the side margins 6' of housing elements 1' the connection region 3' is implemented in each instance.

The engagement mechanism developed in the connection region 3' of the first housing element 1' comprise first latching elements 7' which are disposed along the side margin 6' around the entire periphery about the open front face 5. The first latching elements 7' are implemented as recesses or latching recesses each of which, starting from the side margin 6', extends toward the inside, which means into the volume enclosed by the housing element 1'. Between adjacently disposed latching elements 7' a web 8 is provided in each instance. The side margin 6' is developed as a closed contiguous surface without throughpass openings and also developed on the outer side as a planar surface except for the regions of the recess-shaped latching elements 7'.

The first latching elements 7' are distributed uniformly on the side margin 6' and in each instance disposed are at the same spacings from one another. The webs 8 developed between the adjacent first latching elements 7' have in the peripheral direction of the side margin 6, which means accordingly in the directions x, y, the identical width in each case. The first latching elements 7' are disposed such that they are oriented in alignment with one another in the direction z.

The latching recesses 7' comprise an area which, starting from the side margin 6', is formed concavely for receiving second latching elements of the engagement mechanism, which are developed on a, not shown, second housing element. At the angular point of the concavely formed area the latching recesses 7' have in each instance their greatest dimension toward the outer side of side margin 6' wherein by greatest dimension is to be understood the distance in the perpendicular orientation to the plane of side margin 6'. At the sides oriented perpendicularly to the direction z, the latching recesses 7' are delimited by flat surfaces describing the cross section of the latching recess 7' and disposed in each instance in a plane spanned by directions x, y. The flat surfaces oriented toward the front face 5 serve herein as bearing areas for the second latching elements of the engagement mechanism.

The maximal extent of the bearing areas of the first latching elements 7' for the second latching elements corresponds to the dimension between the angular point of the concavely formed area and the outside of the side margin 6'.

Figure 2A:
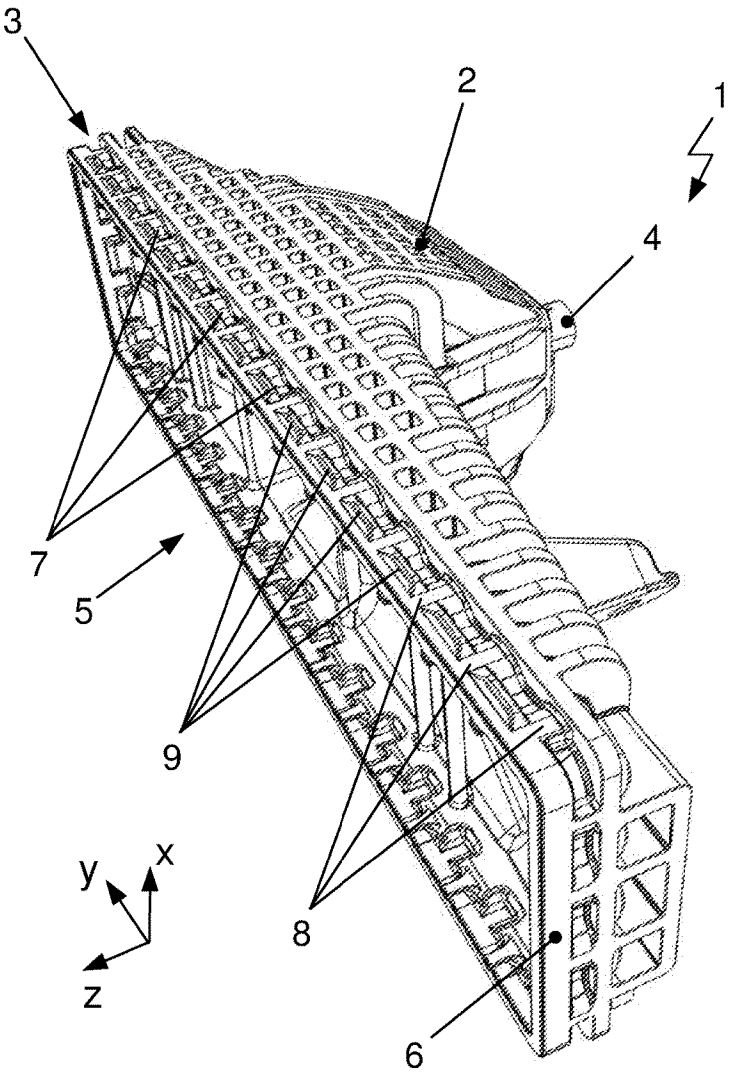
FIGS. 2A and 2B: a first housing element of a device according to the invention for heat transfer with a wall and a connection region in perspective view.
Figure 2B:
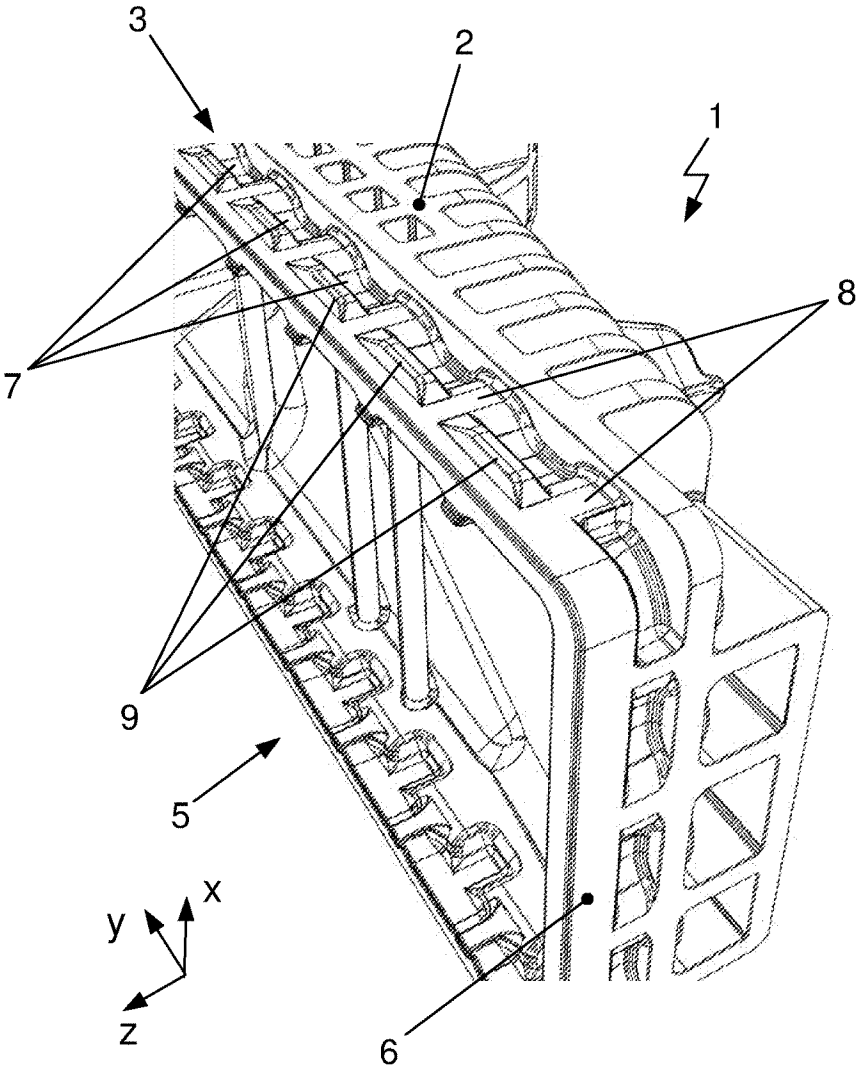

FIGS. 2A and 2B depict a first housing element 1 of a device for heat transfer with a wall 2 and a connection region 3 in perspective view. FIG. 2B shows a detail of the first housing element 1 at an enlarged scale.

The first housing element 1 according to FIGS. 2A and 2B differs from the first housing element 1' according to FIGS. 1A and 1B primarily in the form of the connection region 3 developed as engagement mechanism. In the case of identical developments of the components of the first housing elements 1, 1', reference is made to the descriptions in connection with FIGS. 1A and 1B. Identical components and features are provided with identical reference numbers.

The essential difference between connection regions 3, 3' of the first housing elements 1, 1' can be found in the formation of the first latching elements 7, 7'. The first latching elements 7 of the first housing element 1 according to FIGS. 2A and 2B are developed in the direction z, in particular in the direction of the open front face 5, with shapings 9. The shapings 9 provided between the latching recess 7 and the open front face 5 are disposed on the side margin 6 and protruding outwardly and extent in each instance over the entire extend, oriented in the direction y, of the first latching elements 7.

Each shaping 9 is herein developed as a projection protruding from side margin 6, which projection transitions on three sides continuously into the plane spanned by the side margin 6. The continuous rounded-off transitions between shapings 9 and the side margin 6 represent low-stress regions of wall 2.

On a fourth side, facing the latching recess 7, of shaping 9, the shaping 9 is developed with a flat surface disposed in a plane spanned by directions x, y and has the greatest extent toward the plane of side margin 6. The maximal extent of the bearing areas of the first latching elements 7 for the second latching elements of the engagement mechanism corresponds therewith to the dimension between the angular point of the concavely formed area of latching recess 7 and the outside of side margin 6 plus the extent of the shaping 9 in the perpendicular direction toward the plane of the outside of side margin 6. And therewith, for example, a bearing area of a first latching element 7 disposed on a long side of housing element 1 consequently corresponds to the areas disposed in direction z, describing the cross section of latching recess 7 and, in each instance, disposed in a plane spanned by directions x, y, plus the flat surface developed in each instance on the fourth side, facing the latching recess 7, of shaping 9.

Shapings 9 serve essentially to enlarge the bearing areas of the first latching elements 7 for the second latching elements of the engagement mechanism developed in connection region 3.

Figure 2C:
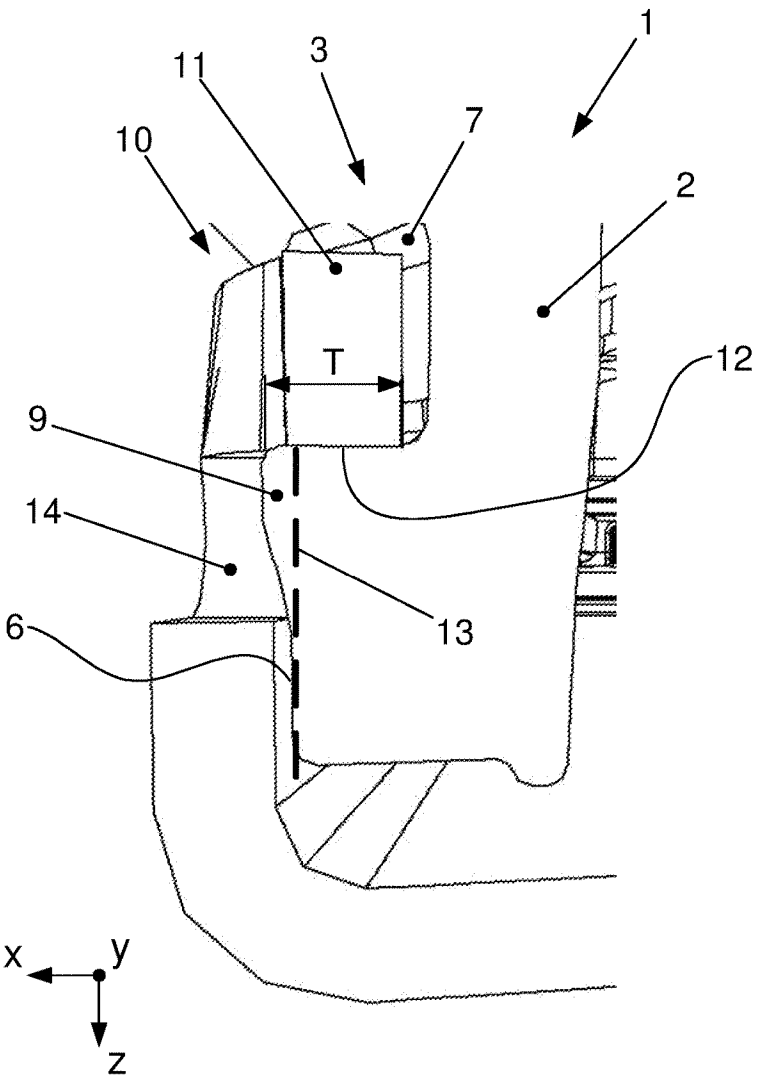
FIGS. 2C and 2D: a system according to the invention for connecting the first housing element of FIGS. 2A and 2B in combination with a second housing element of the device in closed disposition of the system each in a lateral sectional representation.
Figure 1C:
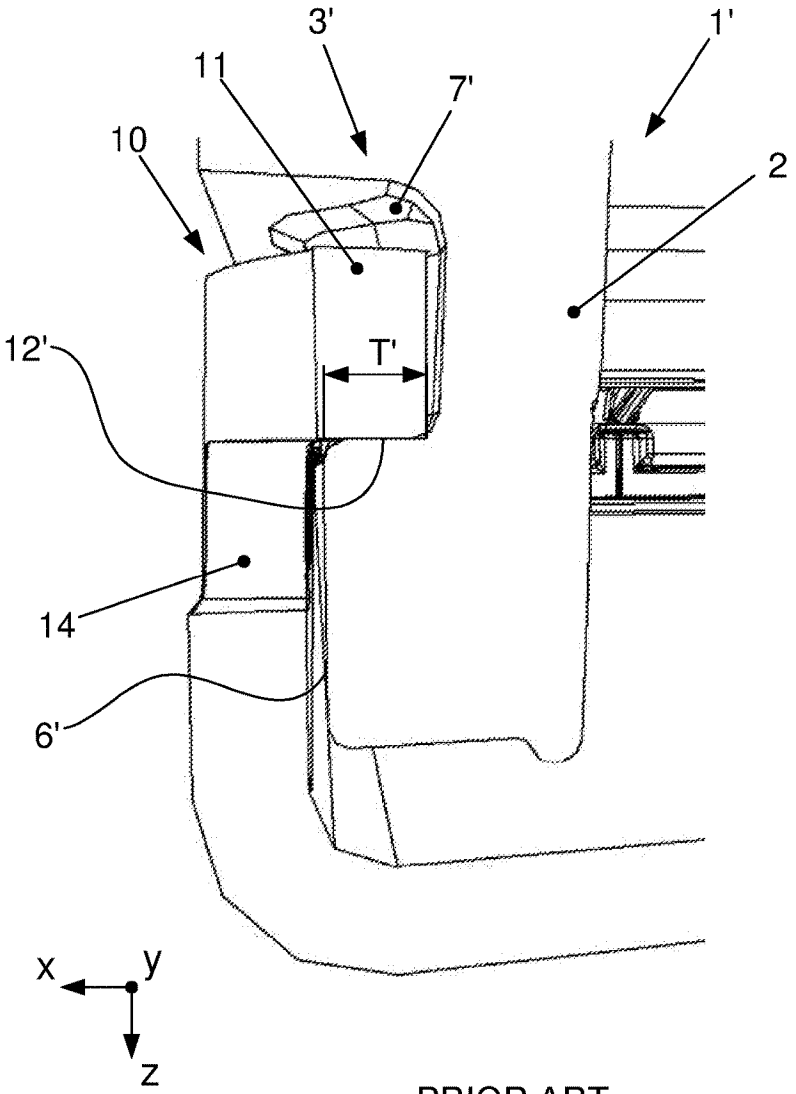
PRIOR ART Fig. 1C
FIGS. 1C and 1D: a system of prior art for connecting the first housing element of FIGS. 1A and 1B in combination with a second housing element of the device in closed disposition of the system, each in a lateral sectional representation.
Figure 2D:
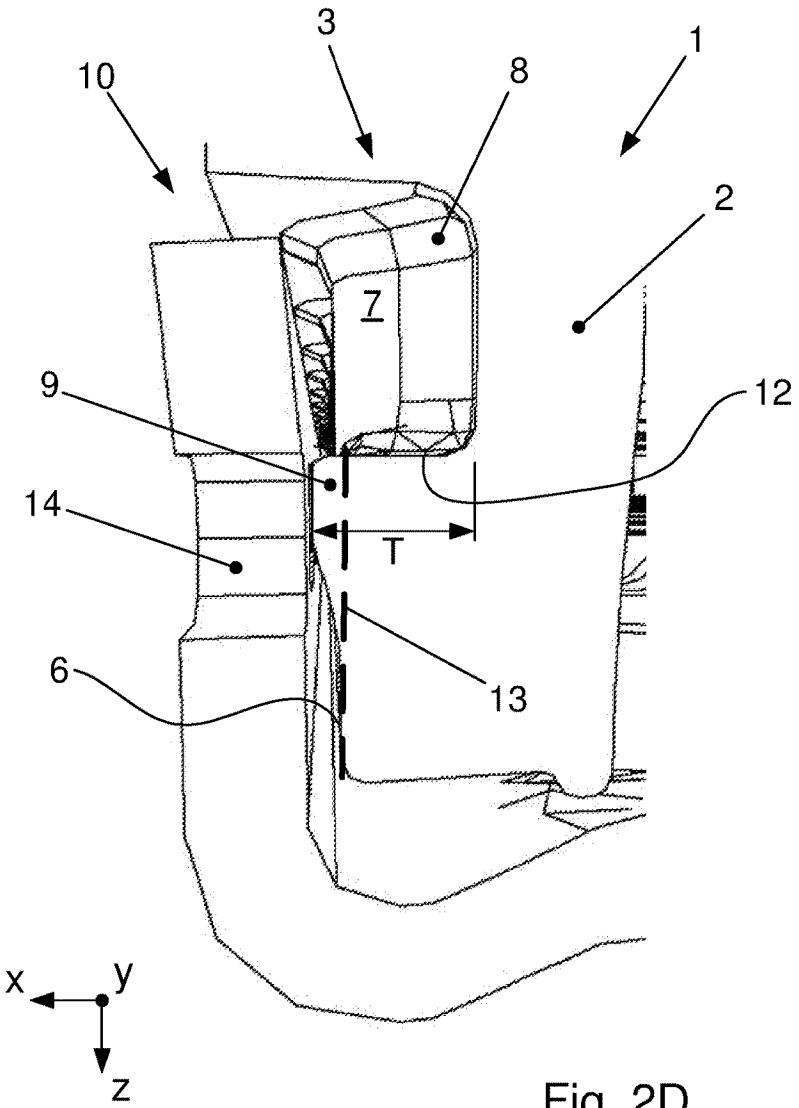
Figure 1D:
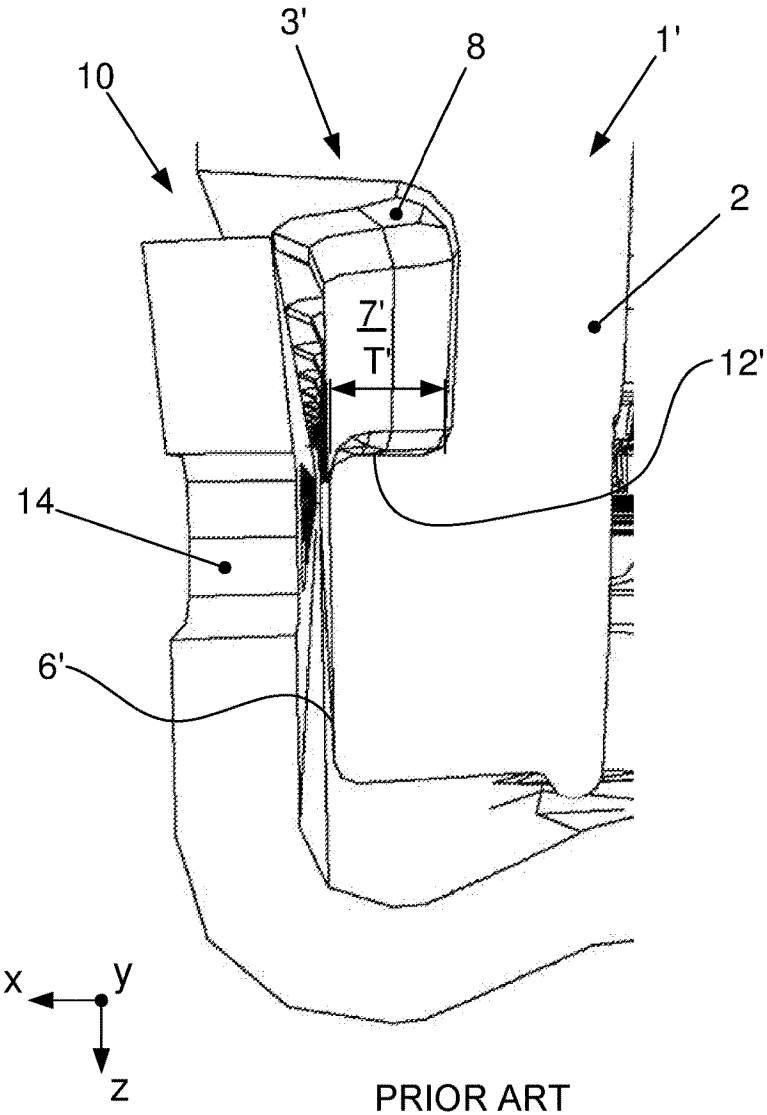
PRIOR ART Fig. 1D

The enlargement of the bearing areas 12 of the first latching elements 7 of the engagement mechanism compared to the bearing areas 12' of the housing element 1' of the engagement mechanism of prior art will become apparent in a comparison of the systems depicted in FIGS. 1C and 1D as well as FIGS. 2C and 2D.

Figure 2E:
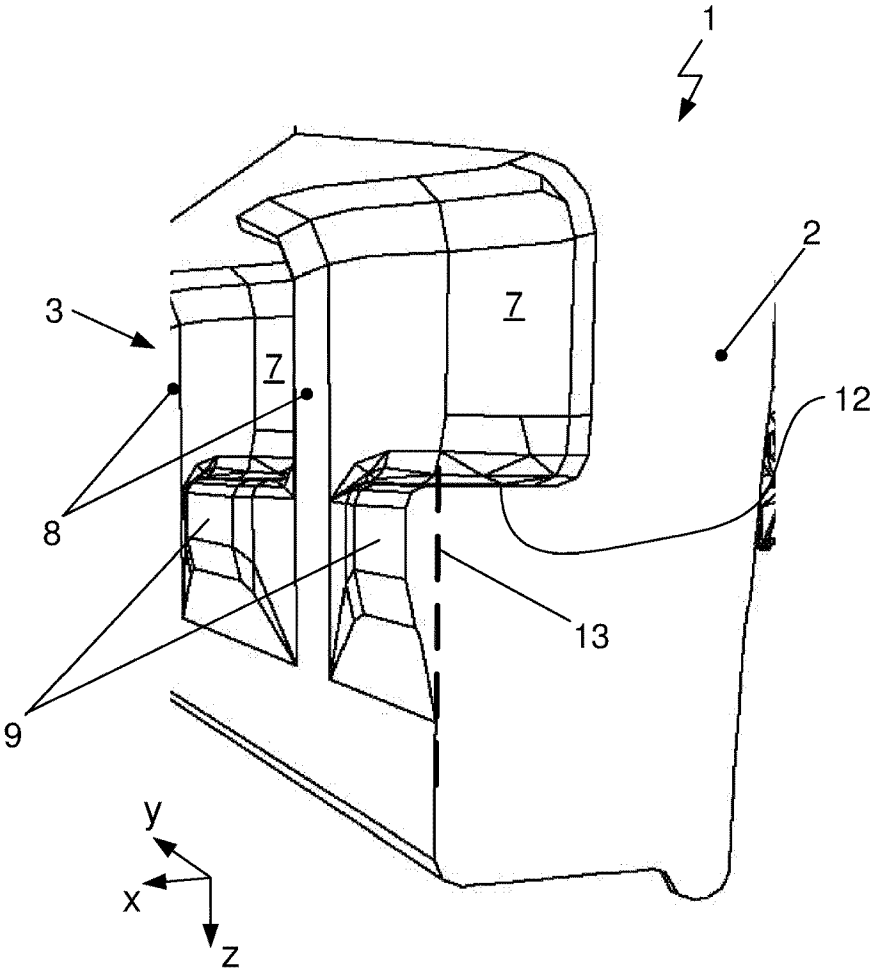
FIG. 2E: the first housing element of the device according to the invention for heat transfer with the connection region in a detail-cut perspective view, as well as FIG. 3: a detail of the second housing element of the device according to the invention for heat transfer in a perspective view.

In each of FIGS. 1C and 1D a prior art system is shown for connecting the first housing element 1' of FIGS. 1A and 1B in combination with a second housing element 10 of the device of prior art, while in FIGS. 2C and 2D is shown a system according to the invention for connecting the first housing element 1 of FIGS. 2A and 2B in combination with the second housing element 10 of the device in closed arrangement of the system in a lateral sectional representation. In FIG. 2E is depicted the first housing element 1 of the device for heat transfer with the connection region 3 in a sectional perspective view.

The second housing element 10 comprises in the connection region 3, 3' second latching elements 11 developed as detent lugs which correspond with the first latching elements 7, 7' and, in connection with the first latching elements 7, 7', represent the engagement mechanism. The second latching elements 11 are developed in a form such that they can be received completely within the first latching elements 7, 7' and comprise in a side, oriented in a plane spanned by directions x, y, a flat bearing area.

In the closed state of the device the bearing areas 12, 12' of the first latching elements 7, 7' and the bearing areas of the second latching elements 11 are in contact on one another. The first latching elements 7, 7' and the second latching elements 11 pressed against one another are connected with one another under form closure.

The size of the bearing areas 12 of the first latching elements 7 of the first housing element 1 according to FIG. 2A to 2D differs in size from the bearing areas 12' of the first latching elements 7' of the prior art first housing element 1' according to FIG. 1A to 1D in the depth T, T' oriented in the direction x. The depth T of the first latching elements 7 is again codetermined by the shaping 9 of the first housing element 1 developed on the side margin 6.

The depth T' of the bearing areas 12' of the first latching element 7' of the first housing element 1' of the device of prior art corresponds herein to the maximal extent of bearing areas 12' as dimension between the angular point of the concavely formed area and the outside of side margin 6'.

In comparison, the depth T of the bearing areas 12 of the first latching element 7 of the first housing element 1 of the device according to FIG. 2A to 2D corresponds to the maximal extent of the bearing areas 12 as dimension between the angular point of the concavely formed area and the outside of the side margin 6 plus the extent of the shaping 9 in the perpendicular direction to the plane of the outside of side margin 6.

The difference between the depths T, T' of bearing areas 12, 12' of the first latching elements 7, 7' is also made clear by the base area 13 depicted in dashed lines. The base area 13 herein corresponds to the outside of side margin 6' of the first housing element 1' of the device of prior art.

Furthermore, in the connection region 3, 3' the second housing element 10 comprises openings 14 which extend, starting from a surface oriented in the direction of the outer side of side margin 6, 6' of the first housing element 1, 1', in the direction x. In a preferred embodiment of the openings 14 as throughpass openings the apertures 14 extend through the wall of the second housing element 10.

The openings 14 are developed such that they correspond with the shapings 9 of the first housing element 1. The shapings 9 developed on the first latching elements 7 are disposed within the openings 14 of the second housing element 10. The region, developed with the openings 14, of the second housing element 10 is also termed the receiving region 14 for the shapings 9.

With the formation of the shapings 9 of the first housing element 1, and therewith the enlargement of bearing areas 12 of the engagement mechanism, the connection properties of the housing elements 1, 10 are optimized and in this way an undesirable releasing of the connection, especially during operation under high stress, for example under high pressure application and high pressure pulse load of the device, is prevented. Herein the interior volume enclosed by the housing, as well as also the overall installation space requirement of the device for heat transfer remain unchanged.

Figure 3:
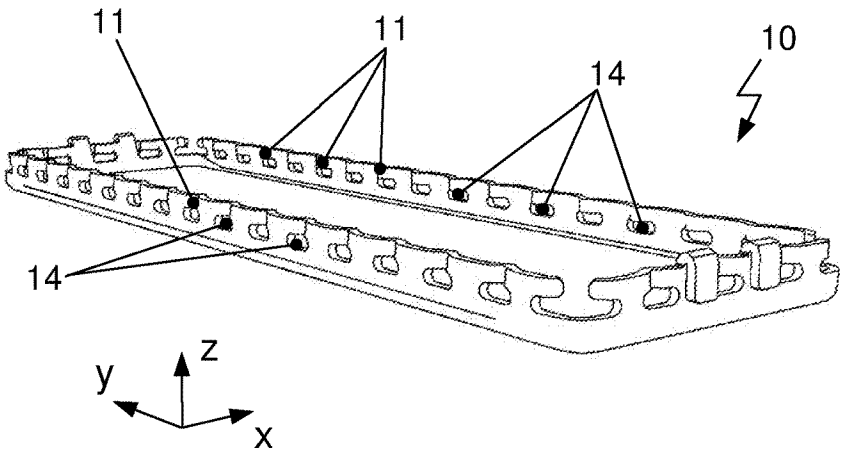

FIG. 3 shows a detail of the second housing element 10, developed as a cover element, of the device for heat transfer in a perspective view. The front face 5 and the top surface of the second housing element 10 are oriented in a plane spanned by the directions x, y. A side margin is developed perpendicularly to the top surface and extends about the entire periphery of the top surface.

The side margin comprises the second latching elements 11 of the engagement mechanism as well as the openings 14 for receiving the shapings 9 of the first housing element 1. The openings 14 developed as throughpass openings through the side margin are in the direction z disposed adjacently to the second latching elements 11 such that one opening 14 is assigned to each second latching element 11.

The adjacently disposed second latching elements 11 are along the front face of the second housing element 10 connected with one another in order to ensure great stability of the engagement mechanism.

LIST OF REFERENCE SYMBOLS

1, 1' First housing element
2 Wall
3, 3' Connection region
4 Passage
5 Front face
6, 6' Side margin
7, 7' First latching element, latching recess
8 Web
9 Shaping
10 Second housing element
11 Second latching element
12, 12' Bearing area engagement mechanism
13 Base area
14 Opening, receiving region shaping 9
x, y, z Direction
T, T' Depth bearing areas It is claimed:

1. A system for connecting housing elements of a device for heat transfer comprising: a housing with a first housing element having a front face and a second housing element having a front face, wherein the first housing element and the second housing element are connectable with one another with their front faces oriented toward one another as well as being connectable via a form-closure connection with one another;

wherein the first housing element has a side margin and the second housing element has a side margin, wherein the first housing element and the second housing element are in contact with one another with their respective side margins developed in the proximity of the front faces, and wherein the connection is implemented as an engagement mechanism with first latching elements disposed on the side margin of the first housing element and second latching elements disposed on the side margin of the second housing;

wherein the first latching elements are developed as recesses, each of said recesses having a flat surface oriented parallel to the front face;

wherein on an outer side of the side margin of the first housing element in each instance between a first latching element and the front face a shaping is implemented protruding from the side margin, which, on a side facing the first latching element comprises a flat surface disposed in the plane spanned by the flat surface of the first latching element such that the flat surface of the first latching element and of the shaping form a contiguous bearing area for a second latching element;

wherein the second housing element comprises openings for receiving the shapings of the first housing element.

2. A system according to claim 1, wherein a side margin is disposed oriented in a perpendicular direction to the front face and is developed about the front face over its entire periphery.

3. A system according to claim 1, wherein a shaping is developed such that it extends over the entire extent, oriented in parallel to the front face, of a first latching element.

4. A system according to claim 1, wherein the shaping protruding from the side margin is developed on the side, facing the first latching element such that it continuously transitions into a plane spanned by the side margin.

5. A system according to claim 1, wherein the first latching elements are developed such that, starting from the side margin they extend into the volume enclosed by the housing.

6. A system according to claim 5, wherein between adjacently disposed first latching elements a web is implemented.

7. A system according to claim 6, wherein the side margin of the first housing element is developed with the first latching elements and the webs as a closed, contiguous surface.

8. A system according to claim 1, wherein the first latching elements are each developed with a concavely formed area starting from the side margin for receiving the second latching elements of the engagement mechanism.

9. A system according to claim 8, wherein the first latching elements at an angular point of the concavely formed area have a depth (T) as the greatest dimension to the outer side of the side margin.

10. A system according to claim 1, wherein the second latching elements are developed as detent lugs with a form such that they are receivable integrated within the first latching elements.

11. A system according to claim 1, wherein the second latching elements comprise in each instance a flat surface oriented in the direction of the bearing areas of the first latching elements, wherein the bearing areas of the first latching elements and the flat surfaces of the second latching elements are disposed such that they are in contact on one another.

12. A system according to claim 1, wherein the housing elements are implemented of an aluminum or a synthetic material.

13. A system according to claim 2, wherein the first latching elements are developed such that, starting from the side margin they extend into the volume enclosed by the housing.

14. A system according to claim 3, wherein the first latching elements are developed such that, starting from the side margin they extend into the volume enclosed by the housing.

15. A system according to claim 4, wherein the first latching elements are developed such that, starting from the side margin they extend into the volume enclosed by the housing.

16. A system according to claim 2, wherein the housing elements have a rectangular cross section with two long sides and two narrow sides and the latching elements are developed at least on the long sides of the housing elements.

17. A system according to claim 3, wherein the housing elements have a rectangular cross section with two long sides and two narrow sides and the latching elements are developed at least on the long sides of the housing elements.

18. A system according to claim 4, wherein the housing elements have a rectangular cross section with two long sides and two narrow sides and the latching elements are developed at least on the long sides of the housing elements.

19. A system for connecting housing elements of a device for heat transfer comprising:

a housing with a first housing element having a front face and a second housing element having a front face, wherein the first housing element and the second housing element are connectable with one another with their front faces oriented toward one another as well as being connectable via a form-closure connection with one another;

wherein the first housing element has a side margin and the second housing element has a side margin, wherein the first housing element and the second housing element are in contact with one another with their respective side margins developed in the proximity of the front faces, and wherein the connection is implemented as an engagement mechanism with first latching elements disposed on the side margin of the first housing element and second latching elements disposed on the side margin of the second housing;

wherein the first latching elements are developed as recesses, each of said recesses having a flat surface oriented parallel to the front face;

wherein on an outer side of the side margin of the first housing element in each instance between a first latching element and the front face a shaping is implemented protruding from the side margin, which, on a side facing the first latching element comprises a flat surface disposed in the plane spanned by the flat surface of the first latching element such that the flat surface of the first latching element and of the shaping form a contiguous bearing area for a second latching element.

20. A system according to claim 1, wherein the housing elements have a rectangular cross section with two long sides and two narrow sides and the latching elements are developed at least on the long sides of the housing elements.

* * * * *